United States Patent [19]

Minami

[11] Patent Number: 4,967,780

[45] Date of Patent: Nov. 6, 1990

[54] ANTI-FREEZING DEVICE

[75] Inventor: Masafumi Minami, Sakai, Japan

[73] Assignee: MIC Co., Ltd., Osaka, Japan

[21] Appl. No.: 351,130

[22] Filed: May 12, 1989

[30] Foreign Application Priority Data

May 14, 1988 [JP] Japan ..... 63-117899
Jun. 1, 1988 [JP] Japan ..... 63-134742

[51] Int. Cl.[5] ..... F16K 31/14; E03B 7/12

[52] U.S. Cl. ..... 137/60; 137/62; 137/338; 236/93 R; 237/80

[58] Field of Search ..... 137/59, 60, 61, 62, 137/338; 237/80; 251/11; 139/79, 334; 236/93 R

[56] References Cited

U.S. PATENT DOCUMENTS 1,473,562 11/1923 Jonsson ..... 137/60
3,380,464 4/1968 Arterbury et al. ..... 137/60
3,511,253 5/1970 Litov ..... 137/60
4,314,580 2/1982 Steinwand ..... 137/375
4,784,173 11/1988 Carney ..... 137/60

FOREIGN PATENT DOCUMENTS 554399 6/1923 France ..... 127/60

*Primary Examiner*—George L. Walton
*Attorney, Agent, or Firm*—Armstrong, Nikaido, Marmelstein, Kubovcik & Murray

[57] ABSTRACT

An anti-freezing device for use in water supply conduits, which includes a driving chamber for imparting a drive to a main valve which is moved by the volumetric expansion due to the freezing of water therein so that the main valve is separated from a valve seat thereby to discharge water in the conduit outside therethrough. The flowing movement of water in the conduit prevents it from freezing.

37 Claims, 15 Drawing Sheets

ANTI-FREEZING DEVICE

BACKGROUND OF THE INVENTION

The present invention relates to an anti-freezing device for use in water supply conduits such as public and household water supplies, and more particularly to an anti-freezing device for such use to prevent the water from being frozen during conveyance without stopping the flow of water.

There have been used a variety of anti-freezing devices, and one example is disclosed in Japanese Utility Model Publication (unexamined) No. 58-129964. This prior art device is adapted for attachment to a water conduit at a place where it is particularly desired to prevent the freezing of water. The device comprises a cylindrical chamber and a working chamber, wherein the cylindrical chamber includes a piston, and a valve secured to the top end of the piston by means of a connecting rod so that the valve comes into contact with the inlet of the cylindrical chamber under the action of the spring. In addition, the device includes several water paths connecting between the working chamber and a part on the conduit where the anti-freezing is required, and a discharge path extending from the working chamber to discharge the water therein outside. When the atmospheric temperature lowers to the freezing-point, the water in the water paths is first frozen thereby to close the cylindrical chamber, and then the water in the working chamber is frozen, thereby causing the volume of water to expand. The volumetric expansion pushes back the piston against the spring, thereby separating the valve from the inlet of the cylindrical chamber. In this way the water in the conduit is introduced into the discharge path through which it is discharged outside. The flowing through the conduit prevents the water from being frozen therein.

This known device is constructed without considering the thermal relationship between the discharging water flowing through the discharge path and the water (or ice) in the working chamber. As a result, once the valve is opened as the water in the working chamber freezes, it is kept open thereby to continue to discharge the water until the ice in the working chamber starts to melt as the atmospheric temperature rises up. Particularly in cold seasons the water discharge lasts for a long time because the rising of atmospheric temperature is slow. This is indeed a waste of water, and is uneconomical.

An object of the present invention is to provide an anti-freezing device adapted for use in water conduits, the device preventing the freezing of water without stopping the flow of it.

More specifically, the anti-freezing device of the present invention opens in response to a drop in the atmospheric temperature, thereby discharging the water in the water supply conduit outside through the device, and closes in response to the temperature of the water almost independently of a rise in the atmospheric temperature. Thus the waste of water is avoided.

SUMMARY OF THE INVENTION

According to the present invention, there is provided an anti-freezing device for use in water supply conduits, the device comprising a cylinder attached to an outlet of the conduit; a main valve including a discharge path, the main valve being movably inserted in the cylinder; a valve seat, positioned in the outlet of the conduit, for closing the main valve when the main valve comes into contact therewith; a driving chamber constituted by an inside wall portion of the cylinder and an outside wall portion of the main valve, imparting a drive to the main valve; a water path for introducing water into the driving chamber from the conduit; and wherein the main valve is moved by the volumetric expansion due to the freezing of water in the driving chamber so that the main valve is separated from the valve seat, thereby discharging the water in the conduit through the discharge path thereof.

Other objects and advantages of the present invention will become more apparent from the following detailed description, when taken in conjunction with the accompanying drawings which show, for the purpose of illustration only, embodiments in accordance with the present invention.

DETAILED DESCRIPTION OF THE PREFERRED EMBODIMENTS

EXAMPLE (1)

Referring to FIGS. 1 to 5, the anti-freezing device is attached to an outlet on a water conduit 1*a*. The outlet is provided by a T-shape branch pipe or coupling 2*a* fixed to the conduit 1*a*. The anti-freezing device includes a cylinder 4*a* having heat exchange fins 3*a* formed on its periphery. The cylinder 4*a* is secured to a saddle section 5*a* of the T-shape pipe 2*a* by threads 6*a* and a nut 7*a*.

Figure 1:
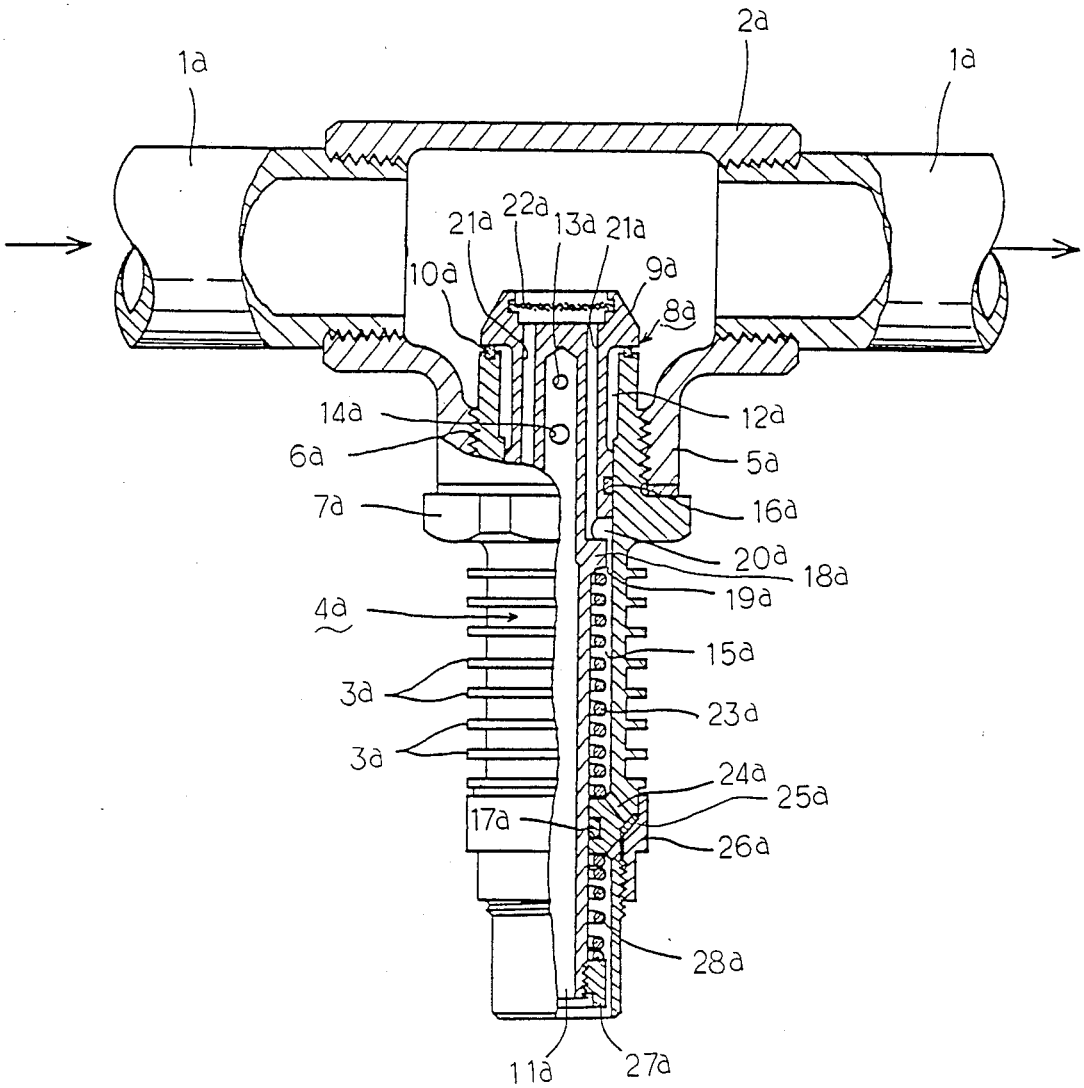
FIG. 1 is a partly cross-sectional front view showing an anti-freezing device according to the present invention.
Figure 2:
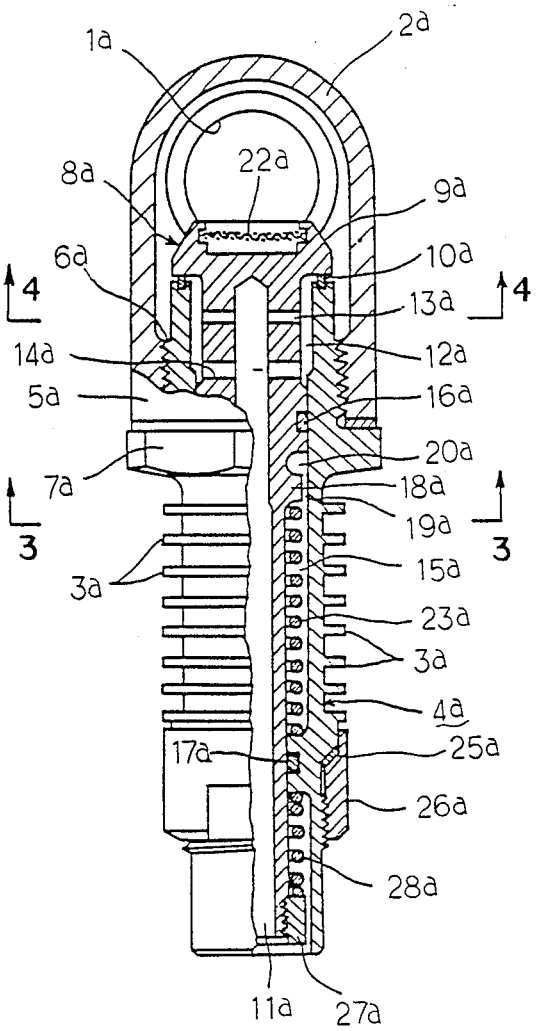
FIG. 2 is a partly cross-sectional side view showing the anti-freezing device of FIG. 1.
Figure 3:
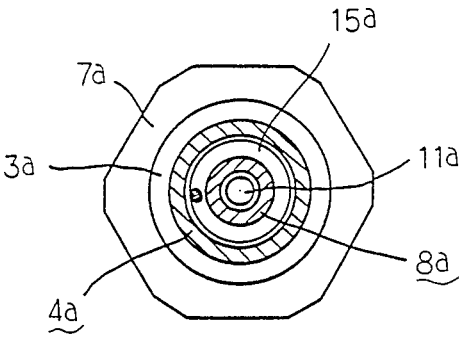
FIG. 3 is a cross-section taken the line A—A in FIG. 2.
Figure 4:
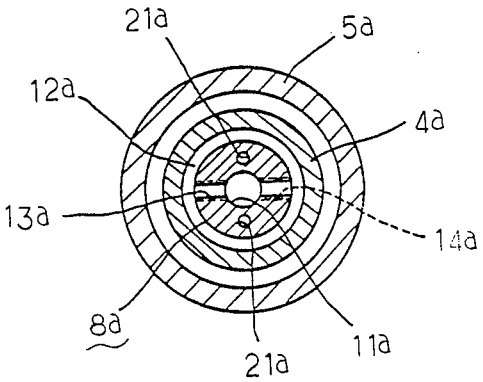
FIG. 4 is a cross-section taken the line B—B in FIG. 2.
Figure 5:
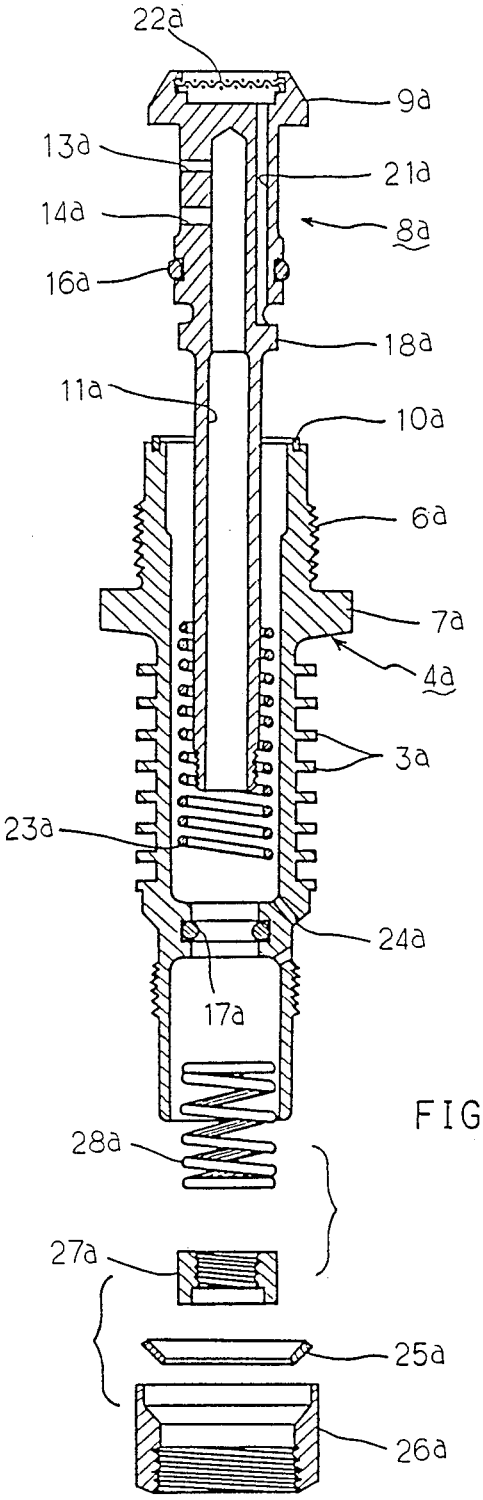
FIG. 5 is an exploded cross-sectional side view of the anti-freezing device of FIG. 1.

The anti-freezing device includes a valve 8*a* which is housed in the cylinder 4*a* in such a manner as to descend and ascend therein. As shown in FIGS. 1 and 2, the valve 8*a* has a bulged head 9*a* which is protruded in the T-shape pipe 2*a*. The bulged head 9*a* of the valve 8*a* is subjected to pressure provided by the water flowing through the conduit 1*a*, and rests on a packing 10*a*, used as a valve seat, disposed on an upper terminating end face of the cylinder 4*a*.

The valve 8*a* includes a water discharge path 11*a* produced axially thereof, the discharge path 11*a* being open outside at a lower end of the valve. There is provided a secondary water path 12*a* defined by the inner wall portion of the cylinder 4*a* and the outer wall portion of the valve 8*a*. The secondary water path 12*a* is connected to the discharge path 11*a* through bores 13*a* and 14*a*. The bore 13*a* has a smaller diameter than that of the bore 14*a*. When the valve 8*a* is opened, the water in the conduit 1*a* is introduced into the discharge path 11*a* by way of the secondary water path 12*a* and the bore 14*a*.

There is provided a driving chamber 15*a* which is defined by an inside wall of the cylinder 4*a* and an outside wall of the valve 8*a*, the driving chamber 15*a* being sealed by O-rings 16*a* and 17*a* at upper and lower ends, respectively. The driving chamber is to cause the valve to open by volumetric expansion involved in the conversion of water into ice in this chamber. The valve 8*a* includes a ring-shaped shoulder 18*a* protruded in an upper section thereof. The shoulder 18*a* and the inside wall of the cylinder 4*a* constitute an initial freezer path 19*a*.

There is provided a recess 20*a* in which air stays, and a water supply path 21*a* whose lower end is connected to the recess 20*a*. As shown in FIG. 1, the water supply path 21*a* extends from the valve head 9*a* to the recess 20*a*, and is connected to the conduit 1*a* through a filter 22*a* disposed on the valve head 9*a*. The water flowing through the conduit 1*a* is introduced into the driving chamber 15*a* by way of the water supply path 21*a*, and fills it up. When the atmospheric temperature is below freezing-point, the water in the initial freezer path 19*a* is first frozen, and then the water in the driving chamber 15*a* is frozen. When the water in the driving chamber 15*a* is frozen into ice, its volume expands and pushes the valve 8*a* upward, thereby separating the valve head 9*a* from the packing 10*a* to open the valve 8*a*.

The driving chamber 15*a* is provided with a heat transfer coiled promotor 23*a* to ensure that the freezing of water or the melting of ice therein is accelerated, and that the heat of the water in the driving chamber 15*a* is minimized without reducing the effective heat transfer area. The cylinder 4*a* is provided with a discharge port 24*a* through which the water in the driving chamber 15*a* is discharged outside. The discharge port 24*a* is closed by a plug 26*a* through a packing 25*a*, the plug 26*a* being screwed to the cylinder 4*a*. When the driving chamber 15*a* is to be cleaned or inspected inside, the water in the driving chamber 15*a* is discharged by removing the plug 26*a*.

The valve 8*a* is provided with a seat 27*a* for receiving a spring 28*a* which biases the valve 8*a* to close.

The anti-freezing device shown in FIGS. 1 to 5, can be used for any water conduits such as public water supply mains, household water supply conduits, industrial piping. As described above, the anti-freezing device is attached to the water conduit through the T-shaped branch pipe or coupling 2*a* as shown in FIG. 1. When the atmospheric temperature lowers to the freezing-point, the water in the initial freezer path 19*a* is first frozen, and then the water in the driving chamber 15*a* is frozen. When the water in the driving chamber 15*a* is frozen into ice, its volume expands and causes the valve 8*a* to ascend. In this way the valve 8*a* is opened. The provision of the initial freezer path 19*a* and the air gathering recess 20*a* ensures that the volumetric expansion is utilized as a drive to the valve 8*a* to open.

When the valve 8*a* is opened, the water in the conduit 1*a* is introduced into the secondary water path 12*a* through a gap between the valve head 9*a* and the packing 10*a*. At this stage air is sent to the secondary water path 12*a* through the small diametric bore 13*a*, thereby conveying the water in the secondary water path 12*a* smoothly to the discharge path 11*a* through which it is discharged outside. Because of the movement of water the conduit 1*a* is protected against frozen water.

If relatively warm water flows into the conduit 1*a*, for example, from a conduit deeply buried in the ground, and is discharged through the discharge path 11*a*, the ice in the driving chamber 15*a* is melted by the warm water. Thus the pressure in the conduit 1*a* and the force of the spring 28*a* are jointly exerted on the valve 8*a* thereby closing it.

When the temperature of water in the conduit 1*a* rises while in use, the valve 8*a* is closed almost independently of the atmospheric temperature. Even when the temperature of water or the atmospheric temperature lowers to freezing-point while the water in the conduit 1*a* is not in use, the valve 8*a* is nevertheless opened.

EXAMPLE (2)

Figure 6:
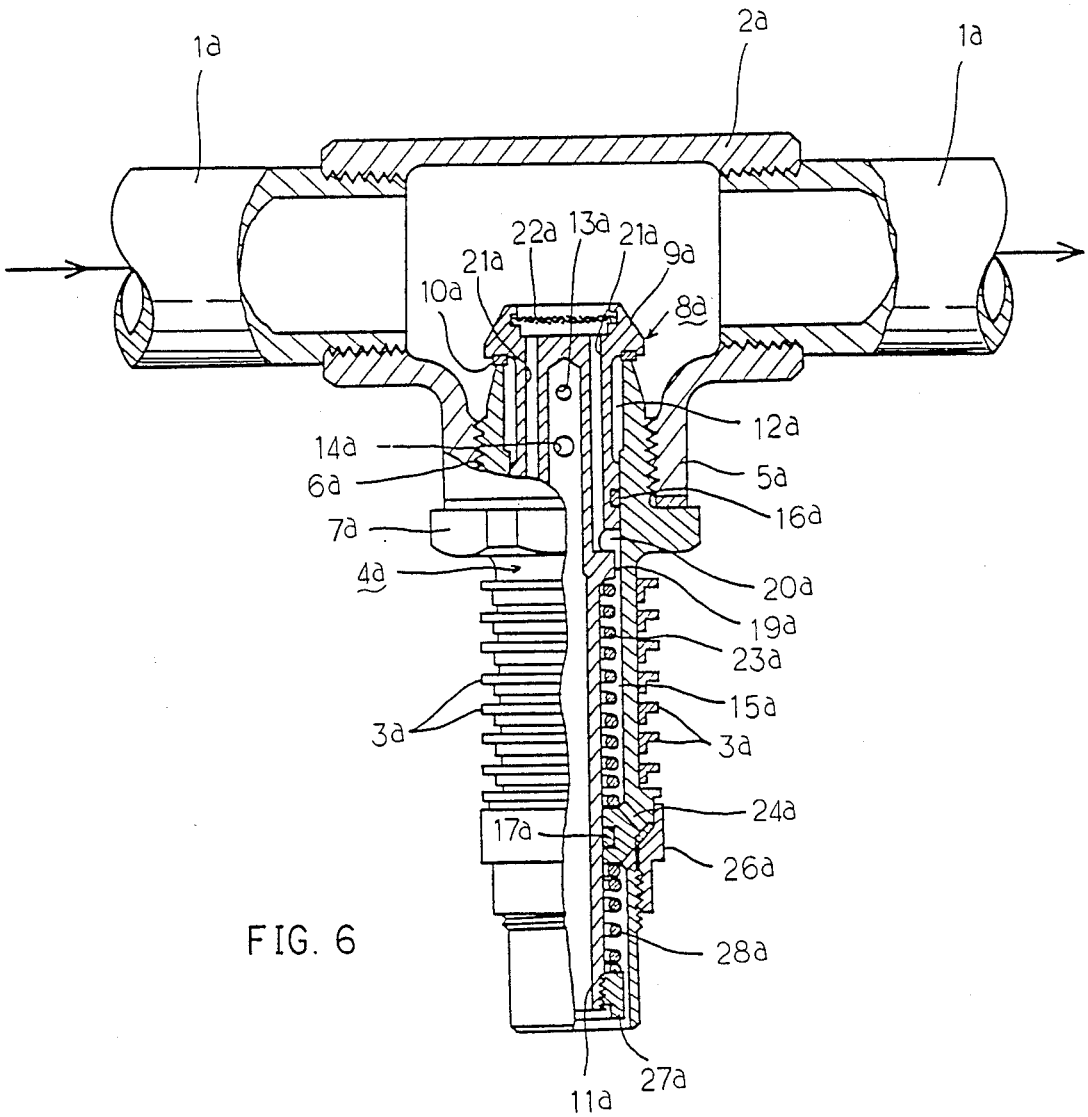
FIG. 6 is a partly cross-sectional front view showing a modified anti-freezing device.

This embodiment is a modification to the anti-freezing device shown FIGS. 1 to 5. In FIG. 6, the heat exchange fins 3*a* are shaped by a press, and pressed into and anchored to the periphery of the cylinder 4*a*. The packing 10*a* is fixed to the valve head 9*a*, and when the valve 8*a* is closed, it rests on the upper end face of the cylinder 4*a*.

EXAMPLE (3)

Figure 7:
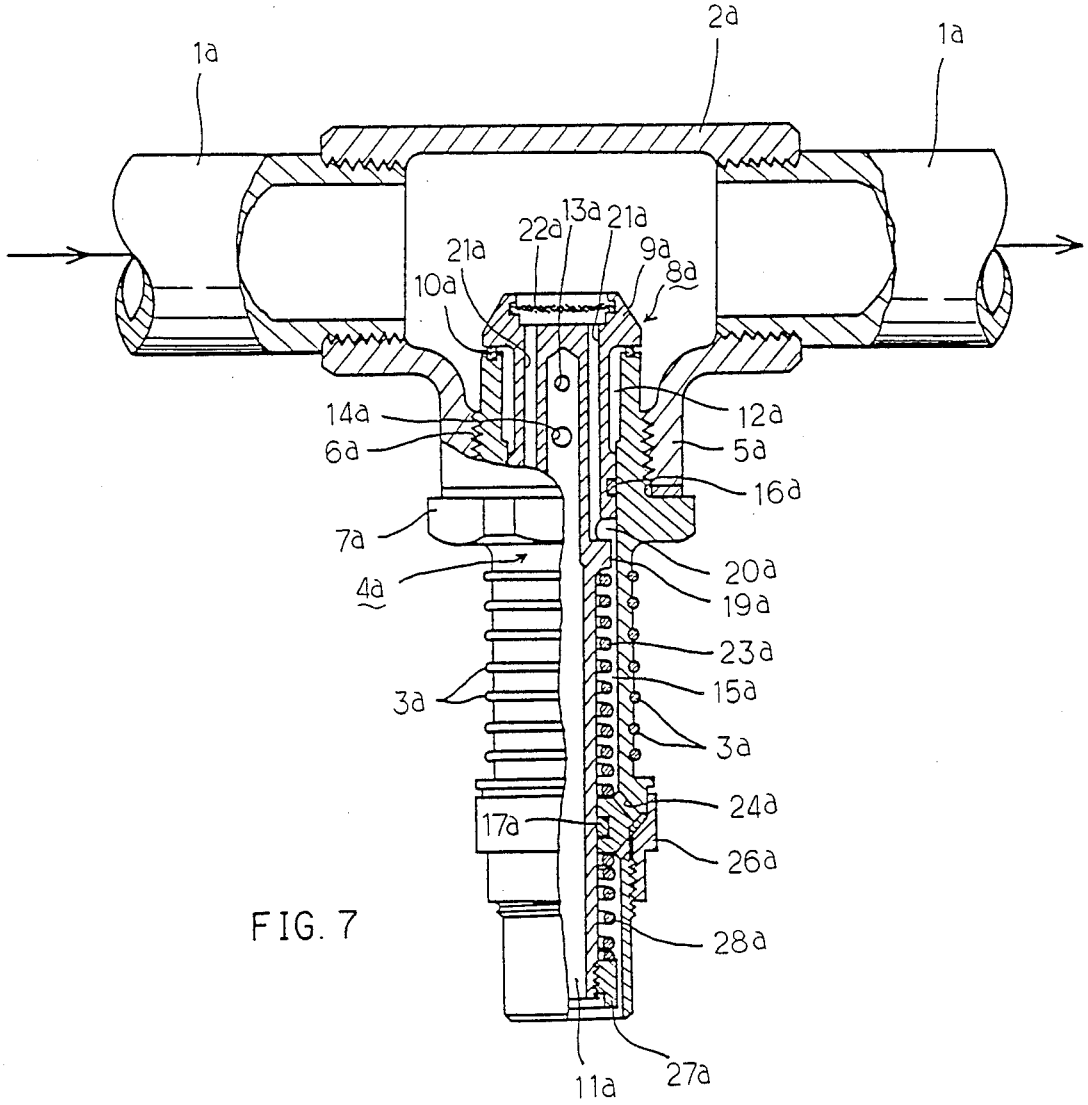
FIG. 7 is a partly cross-sectional front view showing another modified anti-freezing device.

FIG. 7 shows another modification to the anti-freezing device shown in FIGS. 1 to 5. The heat exchange fins 3*a* are made of an aluminum alloy coil which is fixed on the periphery of the cylinder 4*a*.

EXAMPLE (4)

Figure 8:
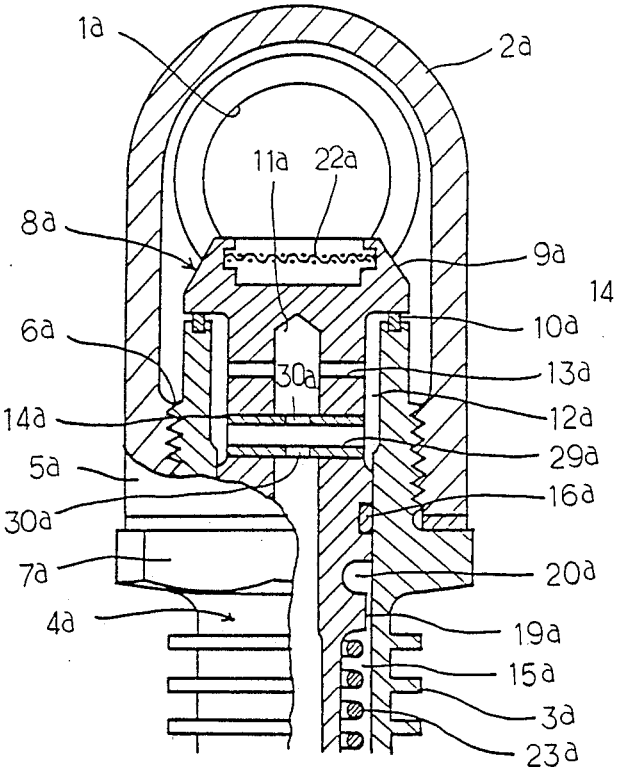
FIG. 8 is a partly cross-sectional front view showing a further modified anti-freezing device.
Figure 9:
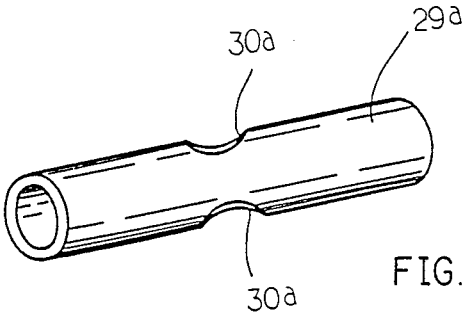
FIG. 9 is a perspective view showing a short pipe used in the anti-freezing device of FIG. 4.
Figure 11:
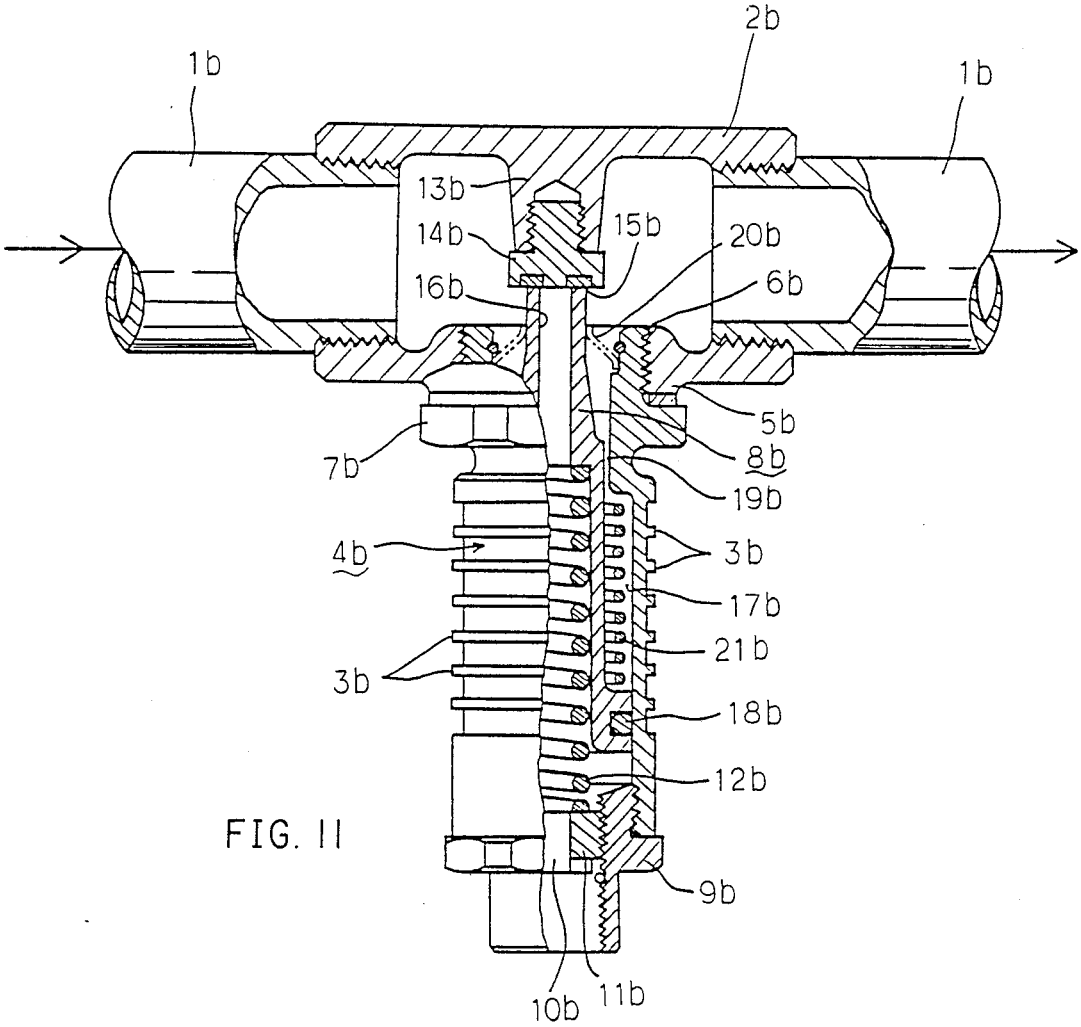
FIG. 11 is a partly cross-sectional front view showing another modified anti-freezing device.
Figure 12:
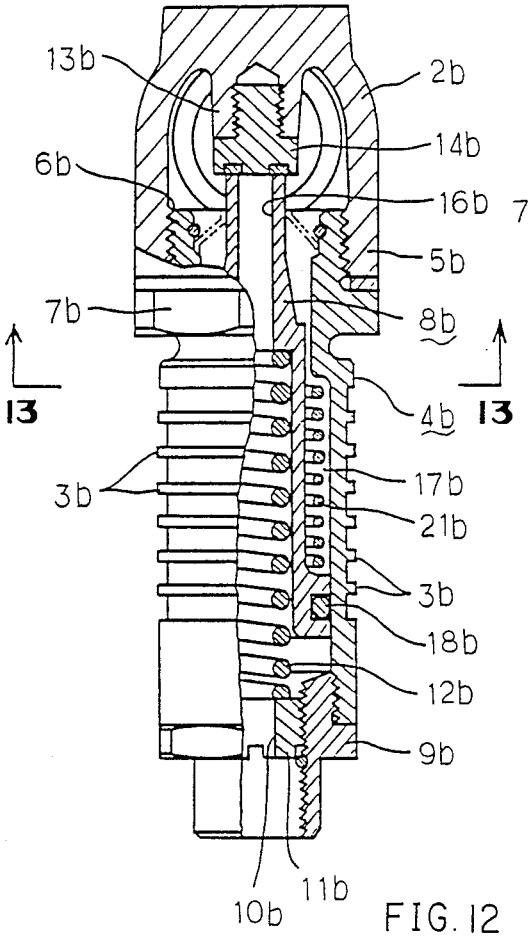
FIG. 12 is a partly cross-sectional side view showing the anti-freezing device of FIG. 11.

This embodiment is a further modification to the anti-freezing device shown FIGS. 1 to 5. In FIGS. 8 and 9 a short pipe 29*a* having pores 30*a* at each side is transversely inserted in the larger diametric bore 14*a* such that one pore 30*a* is open upward and the other is open downward in the discharge path 11*a*. The short pipe 29*a* divides the discharge path 11*a* into an upper section and a lower section. The upper section functions as an air gathering chamber through which air is sent to the secondary water path 12*a* by way of the small diametric bore 13*a*. When the valve 8*a* is opened, this supply of air is effective to enable water to flow from the secondary water path 12*a* to the discharge path 11*a* through the pores 30*a* of the short pipe 29*a*.

EXAMPLE (5)

Figure 10:
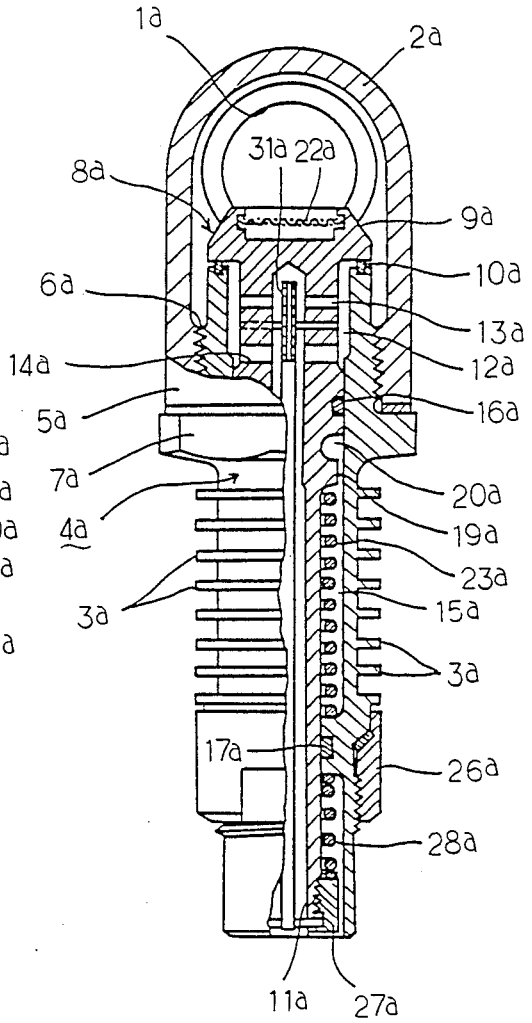
FIG. 10 is a partly cross-sectional side view showing a still further modified anti-freezing device.

This embodiment is a still further modification to the embodiment shown in FIGS. 1 to 5. In FIG. 10 the discharge path 11*a* is provided with an air supply pipe 31*a* whose upper terminating end is open above the small diametric bore 13*a*. The air supply pipe 31*a* sends air to the secondary water path 12*a* by way of the small diametric bore 13*a*, thereby introducing the water in the water path 12*a* into the discharge path 11*a* by way of the large diametric bore 14*a*.

EXAMPLE (6)

Referring to FIGS. 11 to 14, this embodiment will be described:

This embodiment is also attached to a conduit 1*b* through a T-shape branch pipe or coupling 2*b*, which is provided at a required position along the conduit 1*b*.

Figure 13:
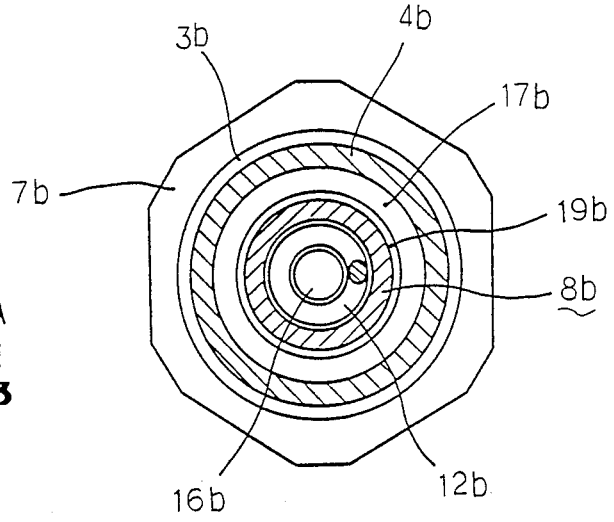
FIG. 13 is a cross-section taken the line A—A in FIG. 12.
Figure 14:
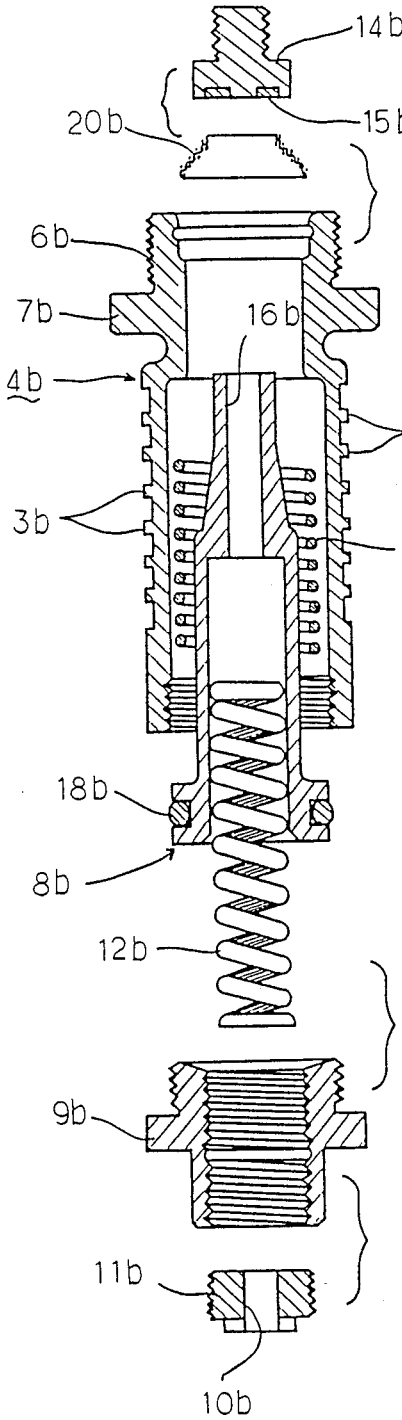
FIG. 14 is an exploded cross-sectional view showing the anti-freezing device of FIG. 11.

More specifically, as shown in FIGS. 13 and 14, the anti-freezing device is provided with a cylinder 4*b* having heat exchange fins 3*b* on its periphery. The cylinder 4*b* is secured to a saddle section 5*b* of the T-shape shape branch pipe 2*b* by threads 6*b* and a nut 7*b* such that the lower terminating end of the cylinder 4*b* is open downward.

The anti-freezing device is also provided with a hollow valve 8*b* housed in the cylinder 4*b* such that the valve 8*b* can descend and ascend. The reference numeral 9*b* denotes a plug to which a spring seat 11*b* having a water discharge port 10*b* is secured. The valve 8*b* is supported by a spring 12*b* resting on the spring seat 11*b*. The spring 12*b* biases the valve 8*b* upwards so as to enable its top end to protrude into the T-shape branch pipe 2*b*.

The T-shape branch pipe 2*b* includes a support member 13*b* to which a valve seat 14*b* having a packing 15*b* is secured. The top end of the valve 8*b* is placed in contact with the packing 15*b*, thereby closing the upper open end of the valve 8*b*. The inner space of the valve 8*b* constitutes a water discharge path 16*b* which has a discharge port 10*b* at its terminating end. When the valve 8*b* is opened, the water in the conduit 1*b* is introduced into the valve 8*b*, and then discharged outside through the port 10*b* of the discharge path 16*b*.

The cylinder 4*b* and the valve 8*b* define a driving chamber 17*b* with opposing wall portions thereof. The lower end of the driving chamber 17*b* is sealed by an O-ring 18*b*. In addition, the cylinder 4*b* and the valve 8*b* constitute an initial freezer zone 19*b* in an upper part of the driving chamber 17*b* with opposing wall portions thereof. The reference numeral 20*b* denotes a filter disposed above the initial freezer zone 19*b*. The conduit 1*b* is connected to the driving chamber 17*b* through the filter 20*b* and the initial freezer zone 19*b*. The water in the conduit 1*b* is introduced into the driving chamber 17*b*, and fills it up. When the atmospheric temperature lowers to the freezing-point, a relatively small quantity of water in the initial freezer zone 19*b* is first frozen, and then a larger quantity of water in the driving chamber 17*b* is frozen. When the water in the driving chamber 17*b* is frozen, its volume expands, and imparts a drive to the valve 8*b* to descend and open.

The driving chamber 17*b* is provided with a heat transfer coiled promoter 21 to ensure that the freezing of water and melting of ice is accelerated and that the heat of the water in the driving chamber 19*b* is minimized without reducing the effective heat transfer area.

This embodiment is also usable for any water supply conduits such as public and household water supplies, industrial uses, as with the use of branch pipes 2*b*. The water in the initial freezer path 19*b* is first frozen as the atmospheric temperature lowers, and then the water in the driving chamber 17*b* is frozen. The frozen water expands its volume to cause the valve 8*b* to descend. In this way the valve 8*b* is opened. Since the initial freezer path 19*b* is located in the upper section of the driving chamber 17*b*, the volumetric expansion in the driving chamber 17*b* can be definitely utilized as a drive to open the valve 8*b*.

When the valve 8*a* is opened, the water in the conduit 1*b* is introduced into the discharge path 16*b* through a gap formed between the valve 8*b* and the packing 15*b*. The water flows to the lower terminating end of the cylinder 4*b* by way of the discharge path 16*b* and the water vent 10*b*, and is discharged outside therethrough. The movement of water in the conduit 1*b* prevents the water from being frozen therein.

While the water in the conduit 1*b* is in use, there is a case where a relatively warm water flows into the conduit from any other source deeply buried in the ground and is discharged outside through the discharge path 16*b*. Under the influence of the warm water the ice in the driving chamber 17*b* melts. Thus the force of the spring 12*b* exerts on the valve 8*b* and closes it. In this way, if the flowing water is relatively warm, the valve 8*b* closes almost independently of whether the atmospheric temperature may be low or not. If, while the water is not in use, the atmospheric temperature is low or the temperature of water in the conduit 1*b* is low, the valve 8*b* will be opened.

EXAMPLE (7)

Figure 15:
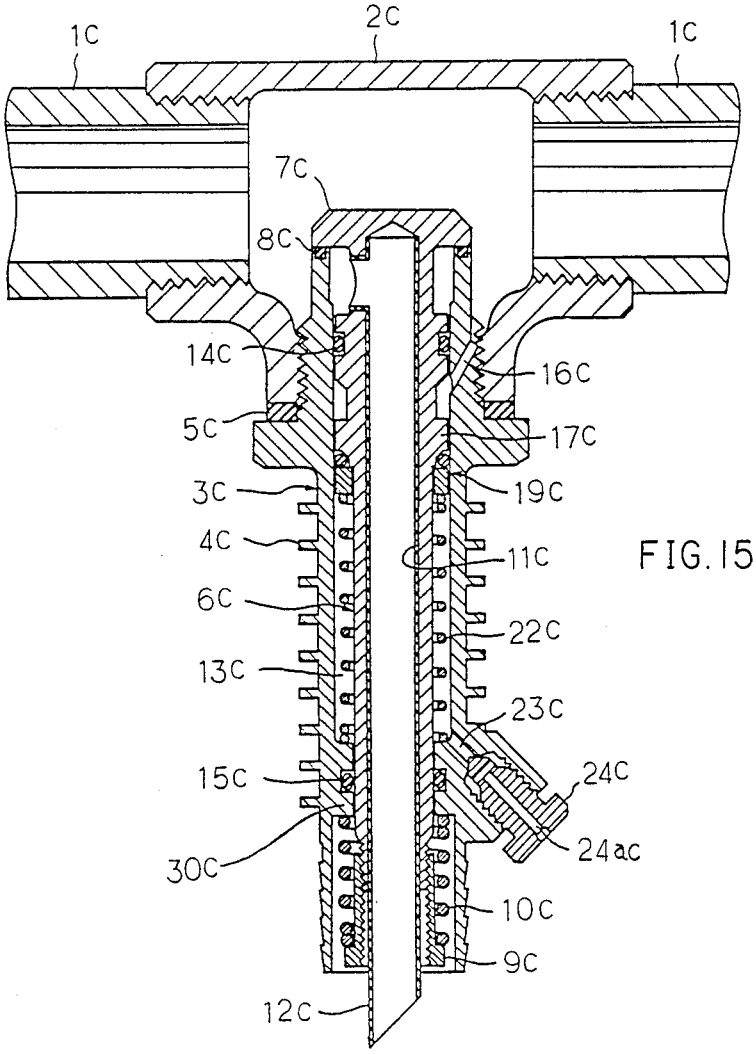
FIG. 15 is a cross-sectional view showing a further modified anti-freezing device.
Figure 16:
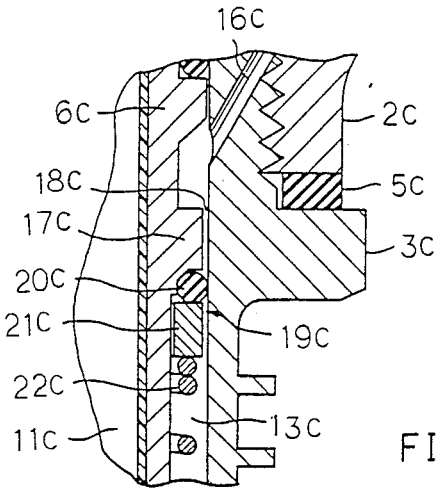
FIG. 16 is a cross-sectional view showing part of the anti-freezing device of FIG. 15.

Referring to FIGS. 15 and 16, the anti-freezing device is attached to the conduit 1*c* through a T-shape branch member 2*c* in the same manner as described with respect to the example (6).

More specifically, as shown in FIGS. 15 and 16, the anti-freezing device is provided with a cylinder 3*c* having heat exchange fins 4*c* on its periphery. The cylinder 3*c* is secured to a coupling 2*c* fixed in a downward opening of the conduit 1*c* wherein the seal between the cylinder 3*c* and the coupling 2*c* is secured by a packing 5*c*.

The cylinder 3*c* accommodates a hollow valve 6*c* which can descend and ascend. The valve 6*c* includes a disc-shaped head 7*c*. The cylinder 3*c* is provided with a valve seat in the form of a packing 8*c* disposed on its terminating end face. The disc-shaped head 7*c* rests on the packing 8*c* when the valve 6*c* descends, whereas, when it ascends the head 7*c* comes out of contact with the packing 8*c*, thereby allowing the water in the conduit 1*c* to enter the cylinder 3*c*. The valve 6*c* is provided with a spring seat 9*c* at its lower end portion, and the cylinder 3*c* includes a ring-shaped shoulder 30*c* formed toward the spring seat 9*c* of the valve 6*c*. There is provided a spring 10*c* between the shoulder 30*c* and the spring seat 9*c*. The valve 6*c* is biased downward by the spring 10c and is normally closed. The inner space of the valve 6c constitutes a discharge path 11c whose top end is open under the valve head 7c. When the valve 6c ascends and separates from the packing 8c, the water in the conduit 1c is introduced into the discharge path 11c through which the water is discharged outside.

The discharge path 11c is lined with a pipe 12c having a smooth inside surface of synthetic resin such as polytetrafluoroethylene. The pipe 12c has such a thickness as not to prevent the heat of the water flowing through the discharge path 11c from transmitting to a driving chamber 13c, which will be water flowing through the discharge path 11c from transmitting to a driving chamber 13c, which will be described below. The lower terminating end portion of the pipe 12c is slantly cut as shown in FIG. 15. The surfacial smoothness of the pipe 12c ensures that the water flows through the pipe 12c without leaving drops on the inside wall thereof. In addition, the synthetic resin pipe 12c is advantageous in that the freezing of water is prevented or at least retarded owing to its insulating property. Thus the discharge path 11c is protected against a choking trouble due to the freezing of water drops remaining on the wall thereof. The slanty cutaway end of the pipe 12c relieves surface tension in the water drops, thereby facilitating the discharge of the water through the discharge path 11c. Instead of the pipe 12c, it is possible to coat the inside surface of the discharge path 11c with plastics.

The driving chamber 13c mentioned above is constituted by the inside wall of the cylinder 3c and the outside wall of the valve 6c. The driving chamber 13c is sealed by O-rings 14c and 15c at the upper end and the lower end thereof. The ring-shaped thin inner space of the driving chamber 13c keeps contact with the inside wall of the cylinder 3c and the outside wall of the valve 6c so that it is sensitive to changes in the atmospheric temperatures and the temperatures of the water flowing through the discharge path 11c. The reference numeral 16c denotes a water supply bore whose top end is open within the coupling 2c, and the reference numeral 18c denotes a gap formed by the inside wall of the cylinder 3c and a flange 17c of the valve 6c. The water supply bore 16c and the gap 18c constitute a water path, hereinafter referred to as water paths. The conduit 1c is connected to the driving chamber 13c through the water paths 16c and 18c.

The driving chamber 13c is provided with a check valve 19c, from the conduit 1c but prevents it from reversely flowing. The check valve 19c comprises an O-ring 20c for effecting the closure and opening of the gap 18c, a retainer ring 21c for backing up the O-ring 20c, and a coil spring 22c for backing up the retainer ring 21c. The coil spring 22c is housed in the driving chamber 13c. The coil spring 22c is made of spring steel. The advantage of the spring steel coil spring 22c is that it is not only effective as a member of the check valve 19c but also accelerates the freezing of water and the melting of ice in the driving chamber 13c because of the fact that spring steel has a specific heat of about 1/10 that of water and a thermal conductivity of 50 to 100 times that of water, thereby increasing the sensitivity of the anti-freezing device.

The cylinder 3c includes a blowhole 23c at its lower section, the blowhole 23c being closed and opened by a blow valve 24c. The driving chamber 13c is open outside through the blowhole 23c. The blowhole 23c is opened by turning the blow valve 24c, thereby discharging the water in the driving chamber 13c outside through the blowhole 23c and a bore 24ac of the blow valve 24c. Since the blowhole 23c is open in the bottom of the driving chamber 13c, sludgy substances and other deposits on the bottom thereof are flown away together with the water. When the blow valve 24c is opened, the internal pressure in the driving chamber 13c drops, thereby enabling the check valve 19c to open automatically. Thus the water in the conduit 1c is introduced into the driving chamber 13c by way of the water paths 16c and 18c.

In operation, if the atmospheric temperature lowers below 0° C., the water in the driving chamber 13c dissipates its heat through the cylinder 3c, and starts to freeze. At this stage the driving chamber 13c is closed by the check valve 19c against the conduit 1c. As a result, the driving chamber 13c allows the water therein to freeze and expand its volume, thereby causing the valve 6c to ascend and open by the volumetric expansion of the water. Thus the water in the conduit 1c is introduced into the discharge path 11c through which the water is discharged outside. The flowing movement through the conduit 1c prevents the water from becoming frozen. While the water flows through the discharge path 11c, the heat thereof is transmitted to the driving chamber 13c through the valve 6c, and melts the frozen water in the driving chamber 13c. Then the valve 6c is descended and closed under the pressure of the water in the conduit 1c and the action of the spring 10c. Subsequently the same process is repeated.

The frozen water in the driving chamber 13c is positively melted by the water flowing through the valve 6c, so that the valve 6c is allowed to close automatically even when the atmospheric temperature is low, thereby stopping the discharge of water immediately. This avoids the waste of water. Since the driving chamber 13c is closed by the check valve 19c, it is not required that the water in the driving chamber 13c freezes later than the water in the water paths 16c, 18c. The valve 6c is sensitive to the freezing of the water in the driving chamber 13c, and is immediately raised. There is no need for considering the location and arrangements of the water paths 16c, 18c and the driving chamber, and the size of the water paths.

EXAMPLE (8)

Figure 17:
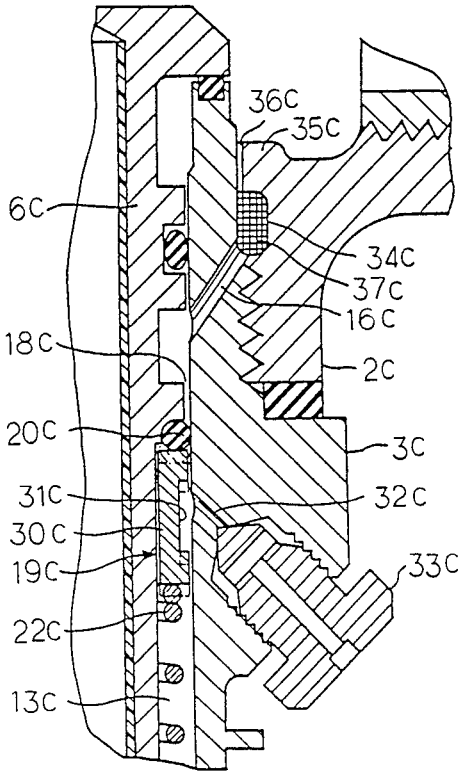
FIG. 17 is a cross-sectional view showing part of a modified anti-freezing device.

This embodiment is a modification to the embodiment shown in FIGS. 15 and 16. In FIG. 17 the check valve 19c includes a lengthwise retainer ring 30c having a recess 31c. The cylinder 3c is provided with a blowhole 32c and a blow valve 33c in opposition to the recess 31c. When the blow valve 33c is opened, the internal pressure in the driving chamber 13c drops, thereby enabling the O-ring 20c to descend. Thus the water in the conduit 1c is introduced into the driving chamber 13c by way of the water paths 16c, 18c and the check valve 19c. In this case, the O-ring 20c keeps contact with the inside wall of the cylinder 3c, so that the water in the driving chamber 13c flows through the insides of the O-ring 20c and the retainer ring 30c, whereas the water flowing along the outside of the retainer ring 30c is discharged through the blowhole 32c. Air tends to remain in the driving chamber 13c but it is forced out together with the water. By providing the blowhole 32c above the driving chamber 13c the flowing directions of water is regulated, and the air staying in the driving chamber 13c is expelled. If air stays therein, the opening operation of the valve 6c will be retarded because of the pneumatic compressibility.

In the illustrated embodiment there is provided a ring-shaped space 34c in which the water path 16c is open, the space 34c accommodating a filter 37c. The reference numeral 35c denotes a projection produced above the ring-shaped space 34c. The reference numeral 36c denotes a gap through which the inside of the coupling 2c is connected to the water path 16c. The filter 37c separates sludgy substances and other impurities from the water flowing from the coupling 2c to the water path 16c.

EXAMPLE (9)

Figure 18:
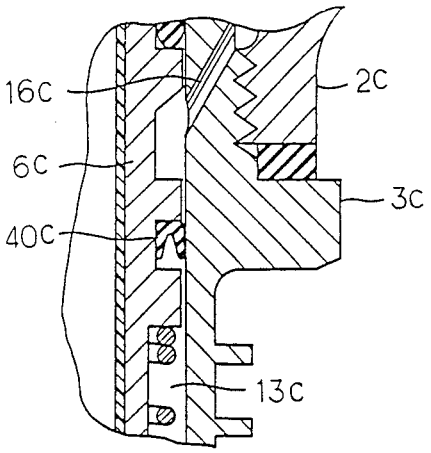
FIG. 18 is a cross-sectional view showing part of another modified anti-freezing device.

This is another modification to the embodiment shown in FIGS. 15 and 16. In FIG. 18 a ring-shaped packing 40c is used as a check valve, the packing 40c having a cross-section of reverse U-shape. The packing 40c is disposed between the valve 6c and the cylinder 3c so as to allow the water to flow from the conduit 1c to the driving chamber 13c but prevents the return flow of water from the driving chamber. The advantage is that the check valve 40c can be made in one piece, thereby simplifying the structure.

EXAMPLE (10)

Figure 19:
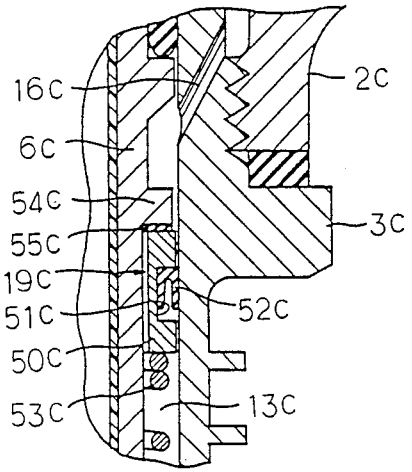
FIG. 19 is a cross-sectional view showing part of a further modified anti-freezing device.

FIG. 19 shows a further modification to the embodiment shown in FIGS. 15 and 16. The check valve 19c comprises a retainer ring 50c having a recess 51c, a ring-shaped packing 52c having a cross-section of reverse U-shape, a coil spring 53c for biasing the retainer ring 50c toward the outlet of the water path, and a gasket 55c positioned between the retainer ring 50c and the flange 54c of the valve 6c. The gasket 55c is thin as compared with O-rings in ordinary use. The disadvantage of O-rings used as a seal is that the opening movement of the valve 6c is retarded because of the fact that the O-rings are excessively compressed by the volumetric expansion due to the conversion of water into ice in the driving chamber 13c. Whereas, the advantage of the thin gasket 55c is that the valve 6c can quickly respond to the volumetric expansion because of the fact that the gasket is less compressible under the volumetric expansion.

EXAMPLE (11)

Figure 20:
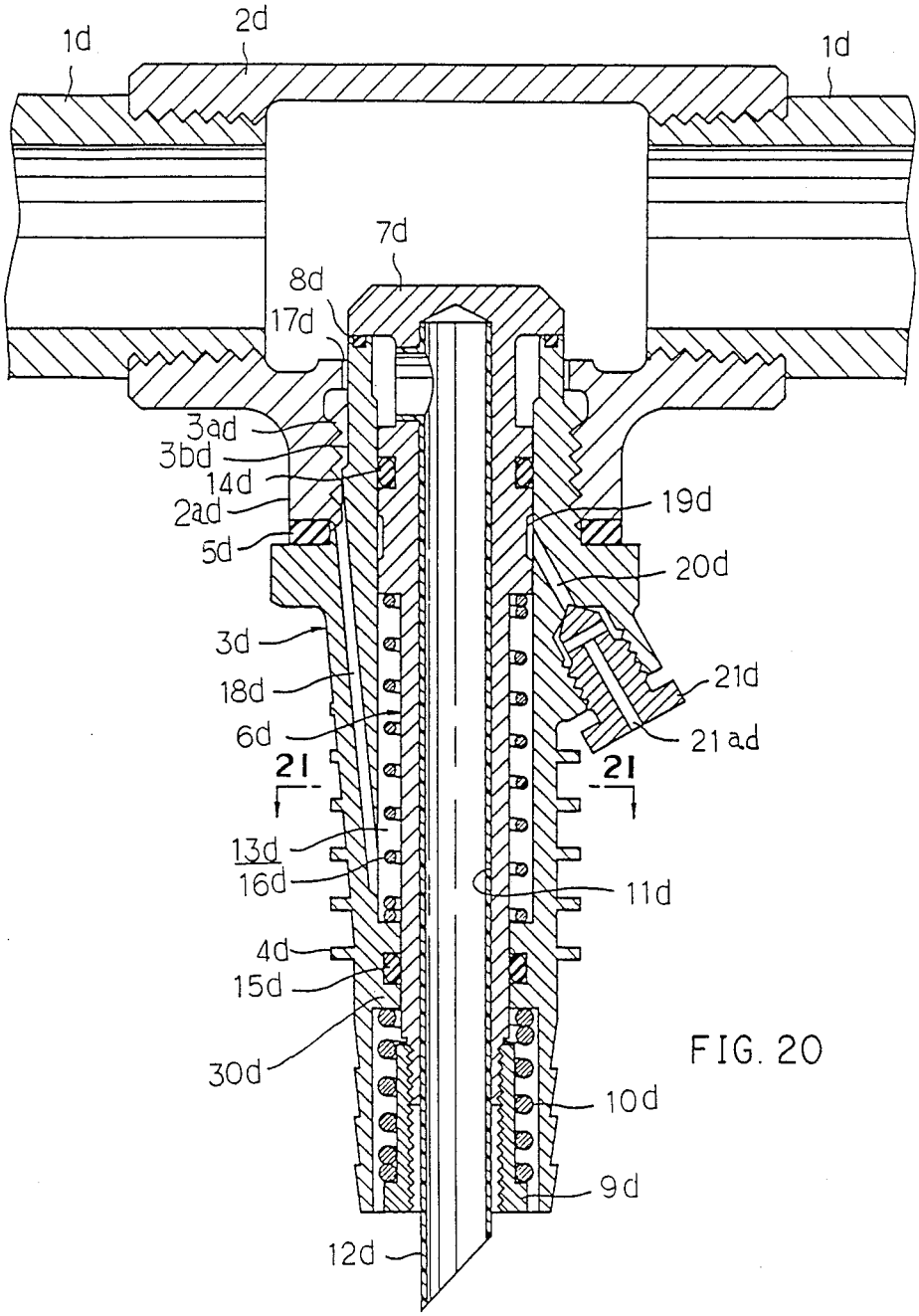
FIG. 20 is a cross-sectional view showing a still further modified anti-freezing device.
Figure 21:
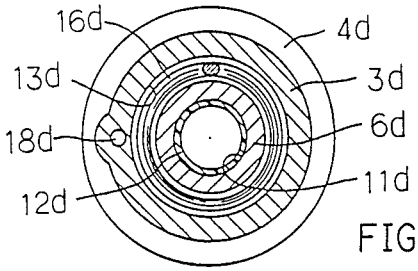
FIG. 21 is a cross-section taken the line II—II in FIG. 20.

Referring to FIGS. 20 and 21, the anti-freezing device is fitted in an outlet 2ad of a T-shaped coupling 2d screwed to the conduit 1d. The device includes a cylinder 3d having cooling fins 4d on its periphery, the cylinder being screwed to the coupling 2d. The seal between the coupling 2d and the cylinder 3d is secured by a packing 5d.

The cylinder 3d accommodates a hollow valve 6d in such a manner as to ascend and descend. The valve 6d includes a disc-shaped head 7d adapted to come into and out of contact with a valve seat packing 8d in accordance with the descent and ascent of the valve 6d. The packing 8d is secured to the upper top end of the cylinder 3d. The valve 6d is provided with a spring seat 9d, and the cylinder 3d has a ring-shaped shoulder 30d. There is provided a spring 10d between the spring seat 9d and the shoulder 30d, the spring 10d biasing the valve 6d to descend (toward closure). The inner space of the valve 6d constitutes a discharge path 11d whose top end is open under the head 7d, and the lower end portion extends downward and is open beyond the terminating end of the valve 6d. When the valve 6d ascends, its head 7d comes out of contact with the packing 8d, thereby enabling the water in the conduit 1d to flow into the discharge path 11d through which the water is discharged outside.

The discharge path 11d is lined with a pipe 12d having a smooth inside surface of syntheitic resin such as polyetrafluoroethylene. The pipe 12d has such a thickness as not to prevent the heat contained in the water flowing through the discharge path 11d from transmitting to a driving chamber 13d which will be described below. The lower end portion of the pipe 12d is slantly cut as shown in FIG. 20. The surfacial smoothness of the pipe 12d ensures that the water flows through the pipe 12d smoothly without leaving water drops on the inside wall thereof. In addition, the resin pipe 12d is helpful in retarding the freezing of water in the discharge path 11d owing to the thermal insulating property of resins. Thus the discharge path 11d is protected against a choking trouble due to the freezing of water drops remaining on the wall thereof. The slantly cut end of the pipe 12d relieves the surface tension of water drops, thereby enabling them to flow easily. This prevents the ice from growing into mass in the lower open end of the pipe 12d. Instead of the pipe 12d it is possible to coat the inside surface of the discharge path 11d with synthetic resin.

The driving chamber 13d mentioned above is constituted by the inside wall of the cylinder 3d and the outside wall of the valve 6d. The driving chamber 3d is sealed by O-rings 14d and 15d at the upper end and the lower end thereof. The driving chamber 13d is formed by a thin ring-shaped space which keeps contact with the cylinder 3d and the valve 6d in a wide range so that it is sensible to the atmospheric temperatures and the temperatures of the water flowing through the discharge path 11d. The driving chamber 13d accommodates a coil 16d as a heat transfer promotor, which is designed to impart no drive to the valve 6d. The coil 16d is made of spring steel. The spring steel has a specific heat of about 1/10 that of water and a thermal conductivity of 50 to 100 times that of water, thereby accelerating the freezing of water and the melting of ice in the driving chamber 13d. Thus the sensitivity of the anti-freezing device is enhanced.

There are provided a ring-shaped gap 17d between the upper end portion of the cylinder 3d and the T-shaped coupling 2d, a groove 3bd produced in external threads 3ad of the cylinder 3d, and a water path 18d slantly formed in the cylinder 3d. The conduit 1d is connected to the driving chamber 13d through the ring-shaped gap 17d, the groove 3bd and the water path 18d.

Since the water path 18d is located outside the driving chamber 13d, the water in the water path 18d is frozen earlier than that in the driving chamber 13d when the atmospheric temperature lowers to the freezing-point. On the contrary, when the ice in the water path 18d and in the driving chamber 13d is respectively melted by the water flowing through the discharge path 11d, the ice in the water path 18d melts later than that in the driving chamber 13d.

There is provided a ring-shaped space 19d between the valve 6d and the cylinder 3d. The cylinder 3d is provided with a blowhole 20d which is open in the ring-shaped space 19d. The blowhole 20d is opened and closed by a blow valve 21. When the blowhole 20d is opened, the internal pressure in the driving chamber 13d drops, thereby introducing the water in the conduit 1d into the driving chamber 13d from below by way of the water path 18d. At the same time the water in the driving chamber 13d is discharged by way of the ring-shaped space 19*d*, the blowhole 20*d*, and an exhaust hole 21*ad* of the blow valve 21*d*. The air staying in the upper portion of the driving chamber 13*d* is expelled together with the water. If the air stays in the upper portion of the driving chamber 13*d* the opening operation of the valve 6*d* is retarded because of the pneumatic compressibility. As described above, since the water path 18*d* is connected to the lowermost portion of the driving chamber 13*d*, and the blowhole 20*d* is connected to the uppermost portion of the driving chamber 13*d*, the air remaining in the driving chamber 13*d* is efficiently exhausted.

In operation, if the atmospheric temperature lowers below 0° C., the water in the driving chamber 13*d* and the water path 18*d* dissipates its heat through the cylinder 3*d* and the water in the water path 18*d* first starts to freeze. At this stage the driving chamber 13*d* is closed by the ice in the water path 18*d*, and the valve 6*d* is raised and opened by the volumetric expansion of the water in the driving chamber 13*d* occurring as it freezes, thereby introducing the water in the conduit 1*d* into the discharge path 11*d* through which it is discharged outside. Since the flow rate of water in the conduit 1*d* increases, the water therein is prevented from becoming frozen. While the water flows through the discharge path 11*d*, the heat of the water is transferred to the driving chamber 13*d* through the valve 6*d*, thereby melting the frozen water in the driving chamber 13*d*. Then the valve 6*d* descends to close under the pressure of the water in the conduit 1*d* and the action of the spring 10*d*. Subsequently the same process is repeated.

The ice in the driving chamber 13*d* is melted, whereas most of the ice in the water path 18*d* remains unmelted because a larger amount of heat transmitted from the water in the discharge path 11*d* to the water path 18*d* is dissipated into the atmosphere. The unmelted ice in the water path 18*d* ensures that the driving chamber 13*d* is airtightly closed, thereby allowing the valve 6*d* to open immediately in response to any volumetric expansion occurring in the driving chamber 13*d*.

As is evident from the foregoing description the flowing water in the valve 6*d* is utilized to melt the ice in the driving chamber 13*d*. The advantage results that although the atmospheric temperature is low, the valve 6*d* is automatically closed, thereby preventing the water flowing through the conduit from being wasted. The saving of water is economical. Since the water in the water path 18*d* freezes earlier than that in the driving chamber 13*d*, the valve 6*d* is immediately opened as soon as the water in the driving chamber 13*d* starts to freeze, thereby protecting the conduit 1*d* against breakage due to freezing. On the other hand, the ice in the water path 18*d* melts later than that in the driving chamber 13*d*, and the ice in the driving chamber 13*d* is completely melted when the valve 6*d* is closed, without leaving no remainder. As a result, the driving chamber 13*d* is unlikely to have a deposit of ice throughout the repeated closure and opening of the valve 6*d*.

EXAMPLE (12)

Figure 22:
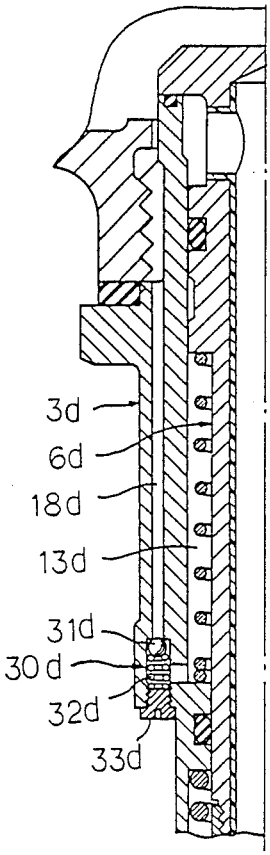
FIG. 22 is a cross-sectional view showing another modified anti-freezing device.

This embodiment is a modification to that shown in FIGS. 20 and 21. Referring to FIG. 22, the water path 18*d* is open beyond the terminating end of the valve 6*d*. When the valve 6*d* ascends, its head 7*d* comes out of contact with the packing 8*d*, thereby enabling the water in the conduit 1*d* to flow into the discharge path 11*d* through which the water is discharged outside.

The discharge path 11*d* is lined with a pipe 12*d* having a smooth inside surface of synthetic resin such as polytetrafluoroethylene. The pipe 12*d* has such a thickness as not to prevent the heat contained in the water flowing through the discharge path 11*d* from transmitting to a driving chamber 13*d* which will be described below. The lower end portion of the pipe 12*d* is slantly cut as shown in FIG. 20. The surfacial smoothness of the pipe 12*d* ensures that the water flows through the pipe 12*d* smoothly without leaving water drops on the inside wall thereof. In addition, the resin pipe 12*d* is helpful in retarding the freezing of water in the discharge path 11*d* owing to the thermal insulating property of resins. Thus the discharge path 11*d* is protected against a choking trouble due to the freezing of water drops remaining on the wall thereof. The slantly cut end of the pipe 12*d* relieves the surface tension of water drops, thereby enabling them to flow easily. This prevents the ice from growing into mass in the lower open end of the pipe 12*d*. Instead of the pipe 12*d* it is possible to coat the inside surface of the discharge path 11*d* with synthetic resin.

The driving chamber 13*d* mentioned above is constituted by the inside wall of the cylinder 3*d* and the outside wall of the valve 6*d*. The driving chamber 3*d* is sealed by O-rings 14*d* and 15*d* at the upper end and the lower end thereof. The driving chamber 13*d* is formed by a thin ring-shaped space which keeps contact with the cylinder 3*d* and the valve 6*d* in a wide range so that it is sensible to the atmospheric temperatures and the temperatures of the water flowing through the discharge path 11*d*. The driving chamber 13*d* accommodates a coil 16*d* as a heat transfer promotor, which is designed to impart no drive to the valve 6*d*. The coil 16*d* is made of spring steel. The spring steel has a specific heat of about 1/10 that of water and a thermal conductivity of 50 to 100 times that of water, thereby accelerating the freezing of water and the melting of ice in the driving chamber 13*d*. Thus the sensitivity of the anti-freezing device is enhanced.

There are provided a ring-shaped gap 17*d* between the upper end portion of the cylinder 3*d* and the T-shaped coupling 2*d*, a groove 3*bd* produced in external threads 3*ad* of the cylinder 3*d*, and a water path 18*d* slantly formed in the cylinder 3*d*. The conduit 1*d* is connected to the driving chamber 13*d* through the ring-shaped gap 17*d*, the groove 3*bd* and the water path 18*d*. Since the water path 18*d* is located outside the driving chamber 13*d*, the water in the water path 18*d* is frozen earlier than that in the driving chamber 13*d* when the atmospheric temperature lowers to the freezing-point. On the contrary, when the ice in the water path 18*d* and in the driving chamber 13*d* is respectively melted by the water flowing through the discharge path 11*d*, the ice in the water path 18*d* melts later than that in the driving chamber 13*d*.

There is provided a ring-shaped space 19*d* between the valve 6*d* and the cylinder 3*d*. The cylinder 3*d* is provided with a blowhole 20*d* which is open in the ring-shaped space 19*d*. The blowhole 20*d* is opened and closed by a blow valve 21. When the blowhole 20*d* is opened, the internal pressure in the driving chamber 13*d* drops, thereby introducing the water in the conduit 1*d* into the driving chamber 13*d* from below by way of the water path 18*d*. At the same time the water in the driving chamber 13*d* is discharged by way of the ring-shaped space 19*d*, the blowhole 20*d*, and an exhaust hole 21*ad* of the blow valve 21*d*. The air staying in the upper portion of the driving chamber 13*d* is expelled together with the water. If the air stays in the upper portion of the driving chamber 13*d* the opening operation of the valve 6*d* is retarded because of the pneumatic compressibility. As described above, since the water path 18*d* is connected to the lowermost portion of the driving chamber 13*d*, and the blowhole 20*d* is connected to the uppermost portion of the driving chamber 13*d*, the air remaining in the driving chamber 13*d* is efficiently exhausted.

In operation, if the atmospheric temperature lowers below 0° C., the water in the driving chamber 13*d* and the water path 18*d* dissipates its heat through the cylinder 3*d* and the water in the water path 18*d* first starts to freeze. At this stage the driving chamber 13*d* is closed by the ice in the water path 18*d*, and the valve 6*d* is raised and opened by the volumetric expansion of the water in the driving chamber 13*d* occurring as it freezes, thereby introducing the water in the conduit 1*d* into the discharge path 11*d* through which it is discharged outside. Since the flow rate of water in the conduit 1*d* increases, the water therein is prevented from becoming frozen. While the water flows through the discharge path 11*d*, the heat of the water is transferred to the driving chamber 13*d* through the valve 6*d*, thereby melting the frozen water in the driving chamber 13*d*. Then the valve 6*d* descends to close under the pressure of the water in the conduit 1*d* and the action of the spring 10*d*. Subsequently the same process is repeated.

The ice in the driving chamber 13*d* is melted, whereas most of the ice in the water path 18*d* remains unmelted because a larger amount of heat transmitted from the water in the discharge path 11*d* to the water path 18*d* is dissipated into the atmosphere. The unmelted ice in the water path 18*d* ensures that the driving chamber 13*d* is airtightly closed, thereby allowing the valve 6*d* to open immediately in response to any volumetric expansion occurring in the driving chamber 13*d*.

As is evident from the foregoing description the flowing water in the valve 6*d* is utilized to melt the ice in the driving chamber 13*d*. The advantage results that although the atmospheric temperature is low, the valve 6*d* is automatically closed, thereby preventing the water flowing through the conduit from being wasted. The saving of water is economical. Since the water in the water path 18*d* freezes earlier than that in the driving chamber 13*d*, the valve 6*d* is immediately opened as soon as the water in the driving chamber 13*d* starts to freeze, thereby protecting the conduit 1*d* against breakage due to freezing. On the other hand, the ice in the water path 18*d* melts later than that in the driving chamber 13*d*, and the ice in the driving chamber 13*d* is completely melted when the valve 6*d* is closed, without leaving no remainder. As a result, the driving chamber 13*d* is unlikely to have a deposit of ice throughout the repeated closure and opening of the valve 6*d*.

EXAMPLE (12)

This embodiment is a modification to that shown in FIGS. 20 and 21. Referring to FIG. 22, the water path 18*d* is made axially of the valve 6*d* and the cylinder 3*d*, and a check valve 30*d* is disposed in the junction between the water path 18*d* and the driving chamber 13*d*. The check valve 30*d* comprises a ball 31*d* for effecting the closure and opening of the water path 18*d*, and a spring 32*d* for biasing the ball 31*d* to close the water path 18*d*, the spring 32*d* being supported by a spring seat 33*d*. The check valve 30 prevents water from flowing from the driving chamber 13*d* to the water path 18*d*. Even if the freezing is incomplete in the water path 18*d*, the freezing in the driving chamber 13*d* enables the valve 6*d* to open immediately. In addition, it is not likely that the ice in the water path 18*d* is moved by volumetric expansion occurring in the driving chamber 13*d*, thereby ensuring that the valve 6*d* is opened.

EXAMPLE (13)

Figure 23:
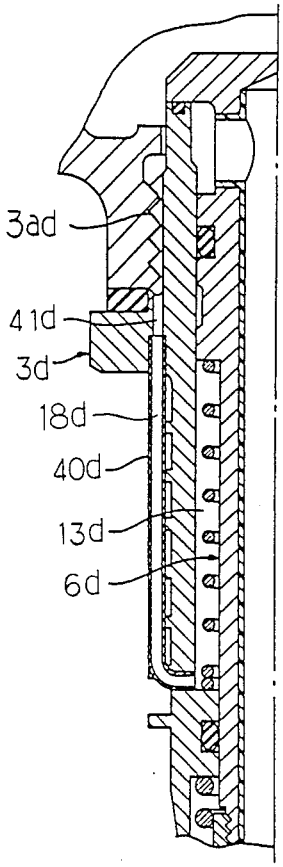
FIG. 23 is a cross-sectional view showing a further modified anti-freezing device.

This embodiment is another modification to that shown in FIGS. 20 and 21. As shown in FIG. 23 the water path 18*d* is constituted by a metal pipe 40*d* secured to the cylinder 3*d*. The upper end of the metal pipe 40*d* is inserted in a bore 41*b* produced adjacent to an external thread section 3*ad* of the cylinder 3*d* and the lower end thereof is connected to the driving chamber 13*d*. It is possible to arrange that the pipe 40*d* is exposed outside so as to expose its outer surface to the atmosphere, and that the pipe 40*d* has such a thin wall as to reduce its heat capacity. As a result the sensibility of the device is increased.

EXAMPLE (14)

Figure 24:
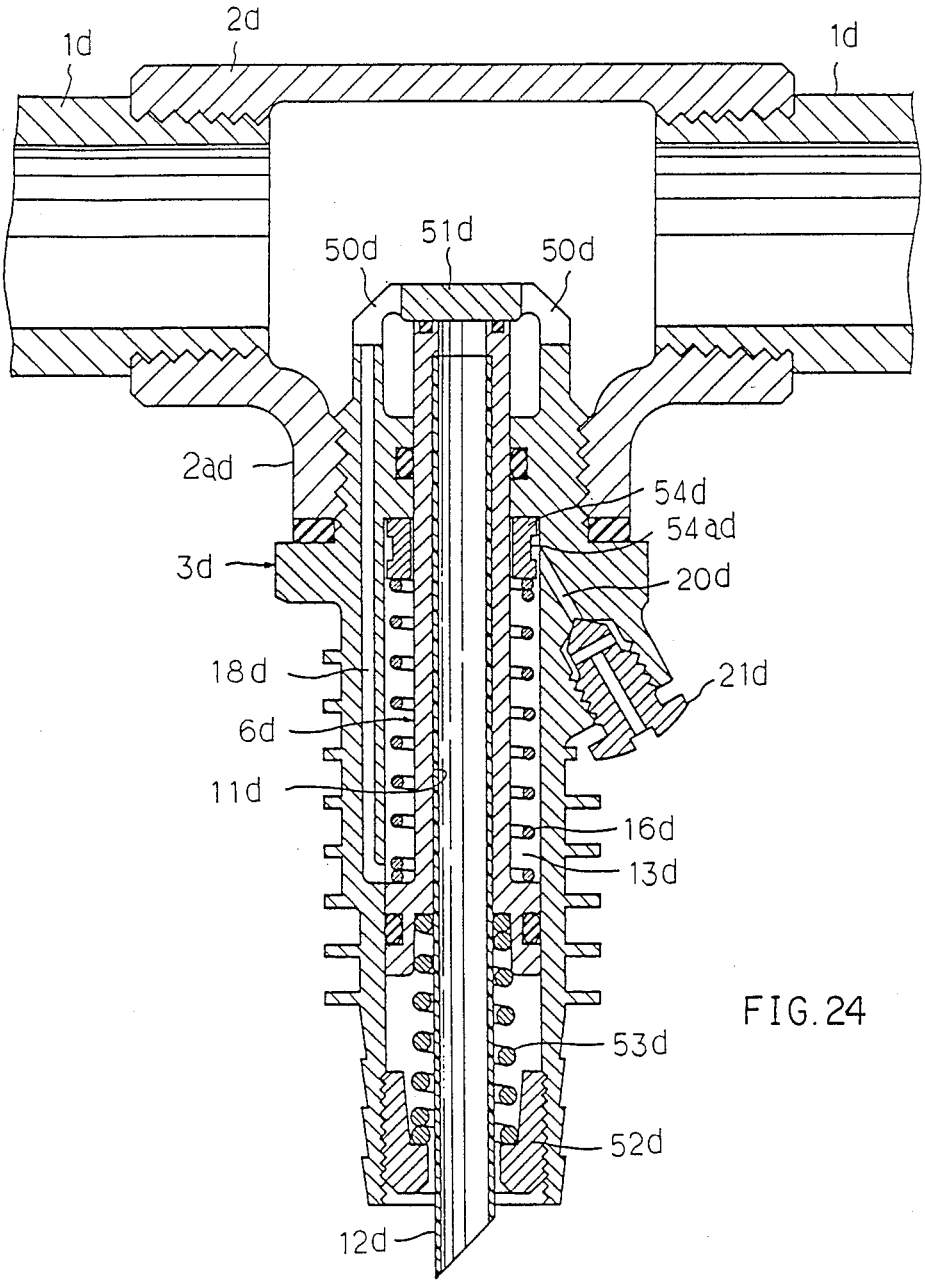
FIG. 24 is a cross-sectional view showing a further modified anti-freezing device.

This embodiment is a further modification to that shown in FIGS. 20 and 21. In FIG. 24 like numerals refer to like members or elements in Example (11) shown in FIG. 20. The cylinder 3*d* is provided with a plurality of cuts 50*d* around the head portion thereof. The reference numeral 51*d* denotes a valve seat whose undersurface is adapted to accept the top end face of the valve 6*d*. When they keep contact with each other, the valve 6*d* is closed, whereas, when they are out of contact with each other, the valve 6*d* is opened. The valve 6*d* is supported at its lower end by a spring 53*d* which rests on a spring seat 52*d*. The spring 53*d* normally biases the valve 6*d* upwards so as to be closed. The water path 18*d* extends downward from the cuts 50*d* and is connected to the bottom of the driving chamber 13*d*. The driving chamber 13*d* accommodates a ring 54*d* which is biased upward by a coil spring 16*d* functioning as a heat transfer promotor. The ring 54*d* includes a recess 54*ad* in its periphery in which an upper end of a blowhole 20*d* is open. The air rises up through the driving chamber 13*d* and collides with the ring 54*d*, and stays in the recess 54*ad*. When the blow valve 21*d* is opened, the air is efficiently expelled through the blowhole 20*d*.

What is claimed is:

1. An anti-freezing device for use in water supply conduits, comprising:

a cylinder attached to an outlet of the conduit;

a main valve having a first outside wall portion, a second outside wall portion, a lower terminating end and an upper top end with a discharge path having an upper top end and a lower terminating end, the discharge path extending substantially the length of and being formed in the main valve, the discharge path providing continuous communication with the outside atmosphere regardless of the position of the main valve, the main valve being movably inserted in the cylinder;

a valve seat, positioned in the outlet of the conduit, for closing the main valve when the main valve comes into contact therewith;

a driving chamber having an upper end and a lower end and, defined by an inside wall portion of the cylinder and the first outside wall portion of the main valve, imparting a drive to the main valve; and a water path for introducing water into the driving chamber from the conduit, wherein the water path extending along the cylinder is directly connected to the driving chamber and positioned to interact more closely with the outside atmosphere than the driving chamber so that the water therein begins to freeze earlier than the water in the driving chamber, and further wherein the main valve is moved by the volumetric expansion due to the freezing of water in the driving chamber so that the main valve is separated from the valve seat, thereby discharging the water in the conduit through the discharge path thereof.

2. An anti-freezing device as defined in claim 1, wherein the main valve comprises a head facing the outlet of the conduit, the valve seat being positioned on the upper end of the cylinder so that the valve seat closes the main valve when the main valve comes into contact with the valve seat and wherein the discharge path extends from a point short of the valve head and is open at the lower terminating end of the main valve, the upper top end of the discharge path being connected to an inner portion of the cylinder which is connected to the conduit when the valve head is separated from the valve seat.

3. An anti-freezing device as defined in claim 2, wherein the valve head is held in contact with the valve seat by a spring.

4. An anti-freezing device as claimed in claim 2, wherein the valve head is held in contact with the valve seat by the pressure of water in the conduit.

5. An anti-freezing device as defined in claim 2, wherein a discharge chamber is defined between the second outside wall portion of the main valve and an inside wall portion of the cylinder adjacent the valve seat, and the main valve comprises an air supply bore connecting between the discharge path and the discharge chamber, the air supply bore being located adjacent to the valve head and communicating the with the outside atmosphere through the discharge path.

6. An anti-freezing device as defined in claim 5, wherein the main valve comprises a pipe positioned within the discharge path, the pipe including pores defined on each side thereof and having a smaller diameter than that of the discharge path, one of the pores being directed toward the air supply bore and other being directed toward the lower end of the main valve.

7. An anti-freezing device as defined in claim 5, wherein the main valve includes an air supply pipe positioned in the discharge path, an upper end of the pipe being open above the air supply bore.

8. An anti-freezing device as defined in claim 1, wherein the water path is integrally formed with the cylinder.

9. An anti-freezing device as defined in claim 1, wherein at least part of the water path is formed from a metal pipe.

10. An anti-freezing device as defined in claim 1, wherein the cylinder is attached to a T-shape coupling member which provides an outlet of the conduit.

11. An anti-freezing device as defined in claim 1, wherein the cylinder includes cooling fins on its periphery.

12. An anti-freezing device as defined in claim 1, wherein the cylinder comprises a blowhole through which the driving chamber is open outside, and a blow valve for closing and opening the blowhole, wherein the water path is connected to the lower end of the driving chamber, and the blowhole is connected to the upper end of the driving chamber.

13. An anti-freezing device as defined in claim 1, further comprising a filter for removing impurities from the water passing through the water path.

14. An anti-freezing device as defined in claim 1, wherein the discharge path in the main valve is lined with a synthetic resin pipe having a smooth inside surface.

15. An anti-freezing device as defined in claim 14, wherein the resin pipe has a slantly cut terminating end.

16. An anti-freezing device as defined in claim 1, wherein the valve seat is supported in the outlet of the conduit so as to close the upper top end of the main valve when the main valve comes into contact therewith under the action of a spring, and wherein the discharge path of the main valve extends from the upper top end of the main valve up to the lower terminating end thereof.

17. An anti-freezing device as defined in claim 1, wherein the driving chamber includes means for facilitating heat transmission.

18. An anti-freezing device as defined in claim 17, wherein the means for facilitating heat transmission is a coil wound around the main valve.

19. An anti-freezing device for use in water supply conduits, comprising:

a cylinder attached to an outlet of the conduit at an inner portion of the cylinder;

a main valve having a first outside wall portion, a second outside wall portion, a lower terminating end and a valve head including a discharge path having an upper top end and a lower terminating end, the discharge path extending substantially the length of and being formed in the main valve, the main valve being movably inserted in the cylinder;

a valve seat, positioned in the outlet of the conduit, for closing the main valve when the main valve comes into contact therewith;

a driving chamber defined by an inside wall portion of the cylinder and the second outside wall portion of the main valve, imparting a drive to the main valve; and a water path having an outlet for introducing water into the driving chamber from the conduit wherein the main valve includes a head facing toward the outlet of the conduit, the valve seat is positioned on the upper end of the cylinder so that the valve seat closes the main valve when the main valve comes into contact therewith, and the discharge path extends from a point short of the valve head and is open at the lower terminating end of the main valve, a discharge chamber is defined between the main valve head, the valve seat, a first outside wall portion of the main valve, and the inside wall portion of the cylinder at the upper end, the upper top end of the discharge path being connected via the discharge chamber to the inner portion of the cylinder which is connected to the conduit when the valve head is separated from the valve seat, and further the main valve includes an air supply bore connecting between the discharge path and the discharge chamber, the air supply bore being located adjacent to the valve head and communicating continuously with the outside atmosphere through the discharge path, and wherein the main valve is moved by the volumetric expansion due to the freezing of water in the driving chamber so that the main valve is separated from the valve seat, thereby discharging the water in the conduit through the discharge path thereof.

20. An anti-freezing device as defined in claim 19, wherein the main valve comprises a pipe positioned at the end of the discharge path which faces the interior of the cylinder, the pipe including pores defined on each side thereof and having a smaller diameter than the end of the discharge path which faces the interior of the cylinder, one of the pores being directed toward the air supply bore and the other being directed toward the lower end of the main valve.

21. An anti-freezing device as defined in claim 19, wherein the main valve includes an air supply pipe positioned in the discharge path, an upper end of the pipe being open above the air supply bore.

22. An anti-freezing device for use in water supply conduits, comprising:

a cylinder having an inside wall portion and an upper end attached to an outlet of the conduit;

a main valve having a first outside wall portion, a second outside wall portion with a discharge chamber defined between the second outside wall portion and the inside wall portion of the cylinder, a lower terminating end and an upper top end including a discharge path, the discharge path providing continuous communication to the discharge chamber with the outside atmosphere, the main valve being movably inserted in the cylinder;

a valve seat, positioned in the outlet of the conduit, for closing the main valve when the main valve comes into contact therewith;

a driving chamber defined by an inside wall portion of the cylinder and the first outside wall portion of the main valve, imparting a drive to the main valve; and a water path having an outlet for introducing water into the driving chamber from the conduit, the water path including an initial freezer path which faces the driving chamber, the initial freezer path being narrowed so that the water therein freezes sooner than the water in the driving chamber, and the water path further including an air gathering section connected to the initial freezer path, and wherein the main valve is moved by the volumetric expansion due to the freezing water in the driving chamber so that the main valve is separated from the valve seat, thereby discharging the water in the conduit through the discharge path thereof.

23. An anti-freezing device as defined in claim 22, wherein the water path includes a path positioned in the main valve, the path connecting between the outlet of the conduit and the air gathering section.

24. An anti-freezing device for use in water supply conduits, comprising:

a cylinder having an inside wall portion and an upper end attached to an outlet of the conduit;

a main valve having a first outside wall portion, a second outside wall portion with a discharge chamber defined between the second outside wall portion and the inside wall portion of the cylinder, a lower terminating end and an upper top end including a discharge path, the discharge path providing continuous communication with the outside atmosphere regardless of the position of the main valve, the main valve being movably inserted in the cylinder;

a valve seat, positioned in the outlet of the conduit, for closing the main valve when the main valve comes into contact therewith;

a driving chamber having an upper end and defined by an inside wall portion of the cylinder and an outside wall portion of the main valve, imparting a drive to the main valve; and a water path having an outlet for introducing water into the driving chamber from the conduit, wherein the cylinder includes a blowhole through which the driving chamber is open to the outside atmosphere and a blow valve for closing and opening the blowhole, the water path being connected to the lower end of the driving chamber, and the blowhole being connected to the upper end of the driving chamber, and further the driving chamber includes a ring positioned at the upper end thereof, having an air gathering groove on its periphery positioned in opposition to the blowhole, and wherein the main valve is moved by the volumetric expansion due to the freezing of water in the driving chamber so that the main valve is separated from the valve seat, thereby discharging the water in the conduit through the discharge path thereof.

25. An anti-freezing device as defined in claim 22 or 24 wherein the main valve includes a head facing the outlet of the conduit, the valve seat being positioned on the upper end of the cylinder so that the valve seat closes the main valve when the main valve comes into contact therewith, and wherein the discharge path extends from a point short of the valve head and is opened at the lower terminating end of the main valve, the upper top end of the discharge path being connected to an inner portion of the cylinder which is connected to the conduit when the valve head is separated from the valve seat.

26. An anti-freezing device as defined in claim 22 or 24, wherein the valve seat is supported in the outlet of the conduit with a spring so as to close the upper top end of the main valve when the main valve comes into contact therewith, and wherein the discharge path of the main valve extends from the upper top end of the main valve up to the lower terminating end thereof.

27. An anti-freezing device as defined in claim 19, 22 or 24 further comprising a filter positioned for removing impurities from the water passing through the water path.

28. An anti-freezing device as defined in claim 19, 22 or 24 wherein the discharge path in the main valve is lined with a synthetic resin pipe having a smooth inside surface.

29. An anti-freezing device as defined in claim 28, wherein the resin pipe has a slantly cut terminating end.

30. An anti-freezing device as defined in claim 19, 22 or 24 wherein the driving chamber comprises means for facilitating heat transmission.

31. An anti-freezing device as defined in claim 19, wherein the water path includes an initial freezer path which faces the drive chamber, the initial freezer path being narrowed so that the water therein freezes sooner than the water in the driving chamber.

32. An anti-freezing device as defined in claim 19, 22 or 24 further comprising a check valve for allowing water to enter the driving chamber from the conduit but preventing the return flow of water from the driving chamber.

33. An anti-freezing device as defined in claim 19, 22 or 24 wherein the water path includes a blowhole through which the driving chamber is open to the outside atmosphere, and a blow valve for closing and opening the blowhole.

34. An anti-freezing device as defined in claim 32, wherein the check valve includes a coil spring made of spring steel positioned in the driving chamber, a retainer ring, and an O-ring pressed by the coil spring through the retainer ring against the outlet of the water path.

35. An anti-freezing device as defined in claim 32, wherein the check valve includes a coil spring made of spring steel positioned in the driving chamber, a retainer ring and an O-ring pressed by the coil spring through the retainer ring against the outlet of the water path, the retainer ring having a lengthwise cross-section and a groove on its periphery, and wherein the blowhole is positioned in the cylinder facing the groove.

36. An anti-freezing device as defined in claim 32, wherein the check valve includes a packing having a U-shape positioned between the main valve and the cylinder.

37. An anti-freezing device as defined in claim 32, wherein the check valve includes a retainer ring positioned between the main valve and the cylinder, the retainer ring having a groove on its periphery, a packing positioned in the groove and kept in contact with an inside surface of the cylinder, a coil spring for pressing the retainer ring toward the outlet of the water path, and a gasket positioned between the retainer ring and a flange on the main valve.

* * * * *